US005785566A

United States Patent [19]

Blanger

[11] Patent Number: 5,785,566

[45] Date of Patent: Jul. 28, 1998

[54] EQUIPMENT FOR BINDING A SKIER TO A WATER SKI OR SKIBOARD

[76] Inventor: Pierre Blanger, 5, Carer Mayor, Pas-de-la-Case, Andorra

[21] Appl. No.: 571,850

[22] PCT Filed: Jun. 17, 1994

[86] PCT No.: PCT/FR94/00734

§ 371 Date: Jun. 17, 1996

§ 102(e) Date: Jun. 17, 1996

[87] PCT Pub. No.: WO95/00387

PCT Pub. Date: Jan. 5, 1995

[30] Foreign Application Priority Data

Jun. 28, 1993 [FR] France ..... 93 08157

[51] Int. Cl.[6] ..... B63B 35/85

[52] U.S. Cl. ..... 441/70

[58] Field of Search ..... 441/65, 70; 280/14.2, 280/611, 615, 616, 623, 632

[56] References Cited

U.S. PATENT DOCUMENTS 5,181,332 1/1993 Uren et al. .

5,334,065 8/1994 Uren et al. ..... 441/70

5,368,320 11/1994 Teeter et al. ..... 441/70

FOREIGN PATENT DOCUMENTS 0 270 175 11/1987 European Pat. Off. ..... A63C 5/03

2 626 189 1/1988 France ..... A63C 5/03

2 669 237 11/1990 France ..... A63C 9/18

40 18 276 6/1990 Germany ..... A63C 9/08

*Primary Examiner*—Stephen Avila

*Attorney, Agent, or Firm*—D. Peter Hochberg; Mark Kusner

[57] ABSTRACT

Equipment for binding a skier to a water ski or skiboard, including two boot assemblies, and a releasable binding assembly mounted onto the ski or skiboard in order to bind these boot assemblies. Each boot assembly includes at least one flexible foot holder which covers all or part of the foot, ankle, and lower end of the leg, a lockable rigid supporting structure (30) covering all or part of the foot holder and having at least one sole with a heel, a metatarsal strap, an instep strap, an upper and portions for engaging the releasable binding assembly each binding assembly including two releasable rear safety abutments and forming a self-contained assembly for each boot assembly.

9 Claims, 4 Drawing Sheets

EQUIPMENT FOR BINDING A SKIER TO A WATER SKI OR SKIBOARD

This invention concerns equipment used for water skiing or skiboarding, in various forms; such as, ski jumping, speed skiing, slalom skiing, figure skiing; and most specifically, the equipment for binding a skier to a water ski or skiboard.

The conventional equipment for binding a skier to a water ski or skiboard is in the form of two straps on the skiboard into which the skier places each of his/her feet, in general without a particularly good fit. This type of binding is inconvenient because it doesn't allow a rigid enough binding of the skier to the skiboard and in this way limits the directional possibilities of the skiboard by the skier.

The conventional equipment for binding the skier to a skiboard or water ski in the form of a covering or casing, usually made of rubber, is fixed onto the ski into which the skier places his/her foot. It is important to have a good means of maintaining the casing or covering of the skier's foot, possibly a part of the ankle or the entire ankle doesn't allow for a precise clamping of the foot in the casing. Therefore, the skier's guidance of the skiboard or skis, which occurs by the foot and possibly a part of the ankle or entire ankle, is relatively imprecise due to the fact that the lower leg doesn't contribute in guiding the skiboard or skis and to the nature of the pliability of the covering's rubber material. The lack of contribution from the lower leg in the guidance of the skiboard or skis causes the skier to lean excessively, especially while turning in order to guide the skiboard or skis. The pliability of the rubber holder/casing holding the foot in the skiboard or ski limits the ability of the skier to react to changes in direction on the water which could turn out to be ineffective for slalom skiing, for example. Likewise, this pliability could create poor guidance for speed skiing or figure skiing.

Previously, with U.S. Pat. No. 5,056,803, there was introduced a way of releasing from the feet from the binding on a water skiboard. The feet are each encased or enveloped by the foot holder and are placed one behind the other on the ski. The foot holder in the rear is fixed onto the ski with a toe piece which could be detached from its holding position. In this method of binding, the two feet are not independent. That is to say that the releasing of one foot, especially while falling, automatically brings about the release of the other foot from the binding. This method of binding does not allow the binding of the rear leg, especially on its front part and leaves the back part free which is necessary for certain types of water skiing. In addition, the shoe utilized in this previous invention only holds the foot and the ankle of the skier, which causes the inconveniences already cited in the example of the conventional water skiing equipment.

This invention remediates these aforementioned disadvantages. More precisely, the invention calls for equipment which binds a skier to a water ski consisting of: a first and a second well-fitting and self-contained assembly which includes a first and a second pliable liner or slipper, each encasing a skier's foot; an ankle of the skier and skier's lower leg of the skier; and a second assembly with a lockable rigid binding, each lockable rigid binding entirely locking liner and each having at least a first sole equipped with a heel, a metatarsal strap on instep belt, a leg section with the aforesaid first and second assemblies being laid out respectively one behind the other characterized in that the aforesaid binding equipment includes, a first rear stop which is able to be released from its holding position and a second rear stop releasable from its holding position. These first and second rear stops releasable from their holding positions are fixed on the ski so that at the time of a fall, the skier can manage the situation.

This feature offers the advantage of allowing the lower leg to participate in the guiding of the ski, by using the lower leg, which creates more possibilities of guiding the ski, especially in the more difficult tight turns, and is good for slalom skiing or figure skiing. The sole of the heel, the metatarsal strap and the instep strap participate in the binding between the lower part of the leg and ski, which creates better precision in guiding the ski; the ensemble giving the skier the ability to react with all parts of the lower part of the leg encased by the aforesaid structure in the boot; therefore obtaining a better distribution of forces, especially for accelerations, rectilinear movements while during centripetal turns.

The two releasable rear stops assure the transmission of forces between the ski and the two rigid binding assemblies; this in case of a fall allows for the mechanical release of the rear stops which releases the binding structures of the ski independently. A practical advantage of the independence of the rear stops is the fact that it allows the skier after a fall to be able to engage the binding assembly without outside assistance while in the water.

According to another feature of this invention, the aforesaid first and second releasable rear stops, detachable from the bindings, include means to put into place on a first and second rear parts, respectively the aforesaid first and second rigid lockable holding, the upper part from the first and from the second heel of the said skier in order to make up the joining of the first and second self-contained structures one behind the other.

This feature advantageously allows the jointed positioning of the self-contained assemblies one behind the other, and also the total clearing of the space located directly behind the self-contained bodies, by the rear stop.

According to another feature, the equipment binding the skier to a water ski according to this invention includes a first front stop mounted onto the ski, for an insertion wherein one cover is supported by another part in the front of the lockable assembly; the first stop surrounding the first cover in order to permit a jointed positioning of the first and second self-contained bodies one behind the other.

This feature allows one advantageously and essentially to clear the space located directly in front of the self-contained structure, assuring rigid security for the assembly, in cooperation with the releasable rear stop, and while allowing a jointed positioning of the self-contained assemblies one behind the other.

Other advantages and features will appear in the description found in the appended drawings which illustrate an example of the utilization of the equipment binding a skier to a water ski according to this embodiment, the example given in the title of the illustration and without restricting the scope of the patent.

Figure 1:
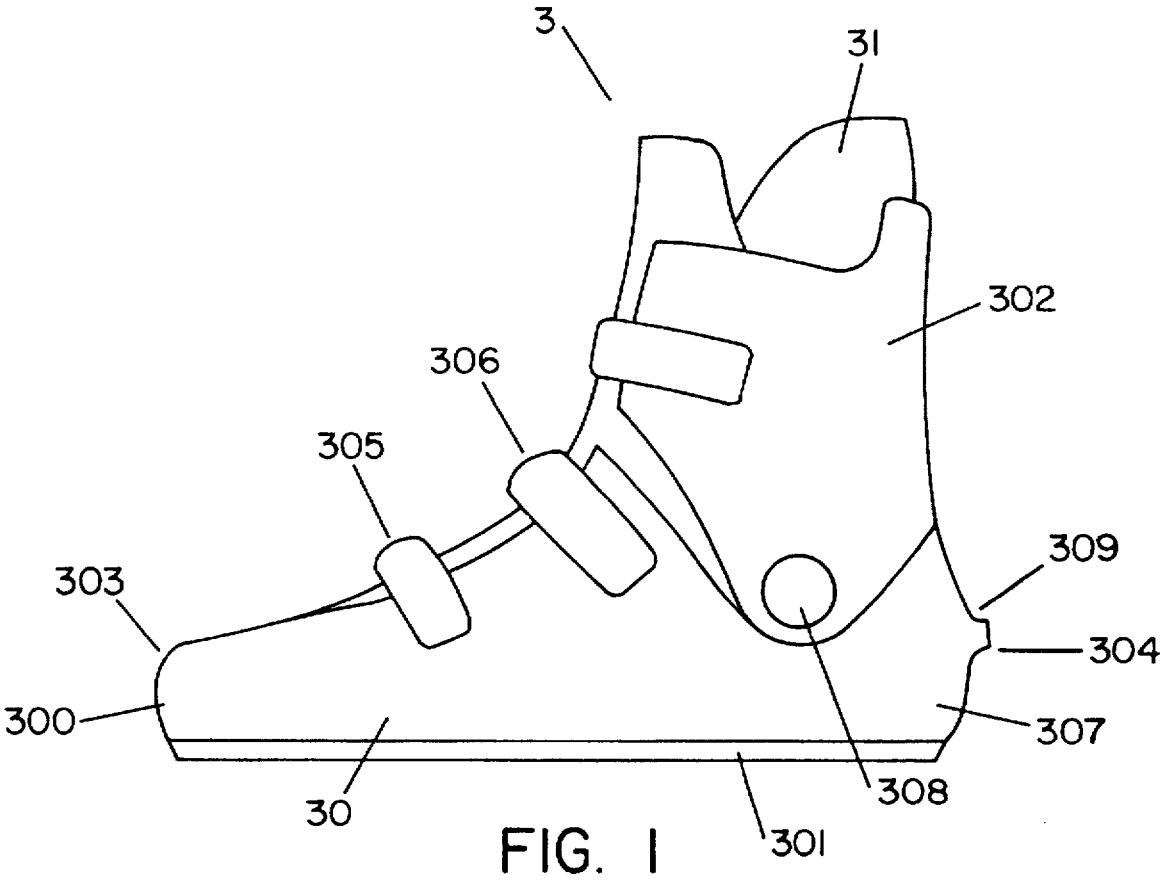
FIG. 1 shows a front view of the self-contained assembly according to this invention, including a lockable binding structure and which has a pliable liner inside.

The self-contained assembly 3 shown in FIG. 1 includes a pliable liner 31, which can cover a foot, an ankle, and lower leg of the skier, who inserts his/her foot into the liner in a conventional manner, which is then advantageously locked once the skier's foot has been inserted. The liner 31 can be made up of a spongy material so that it is able to form a cavity or space saturated with water to a temperature similar to the skier's body, in a way to give some warmth.

The self-contained assembly 3 according to FIG. 1 includes bindings 30 advantageously made of plastic material which can cover the flexible liner 31, having a rigid sole 30 and a rigid heel 307, a lockable metatarsal strap, an instep strap 306 also equally lockable, a rigid lower leg portion 302 also lockable, which has a joint 308 having an axis of rotation equivalent to that defined by the ankle during forward flexion. The two foot straps, the metatarsal one and the instep one, insure the support of the parts of feet involved and bold the sole and heel, in the liner in a way that is optimal for the foot on the ski. The lower leg portion 302 which is jointed allows the skier to use his/her lower leg in a way so that it can help guide the ski, making it possible to bend by means of a hinge or joint 308, movement which is especially necessary to maintain control of the skis in the case of big waves. The two straps and the lower leg portion are equipped to be independent and releasable, for example by regulating hooks or fasteners, like those shown in FIG. 1, with the goal of holding the liner and insuring the optimal binding with the least possible interference between the lower part of the lower assembly and the ski.

Figure 2:
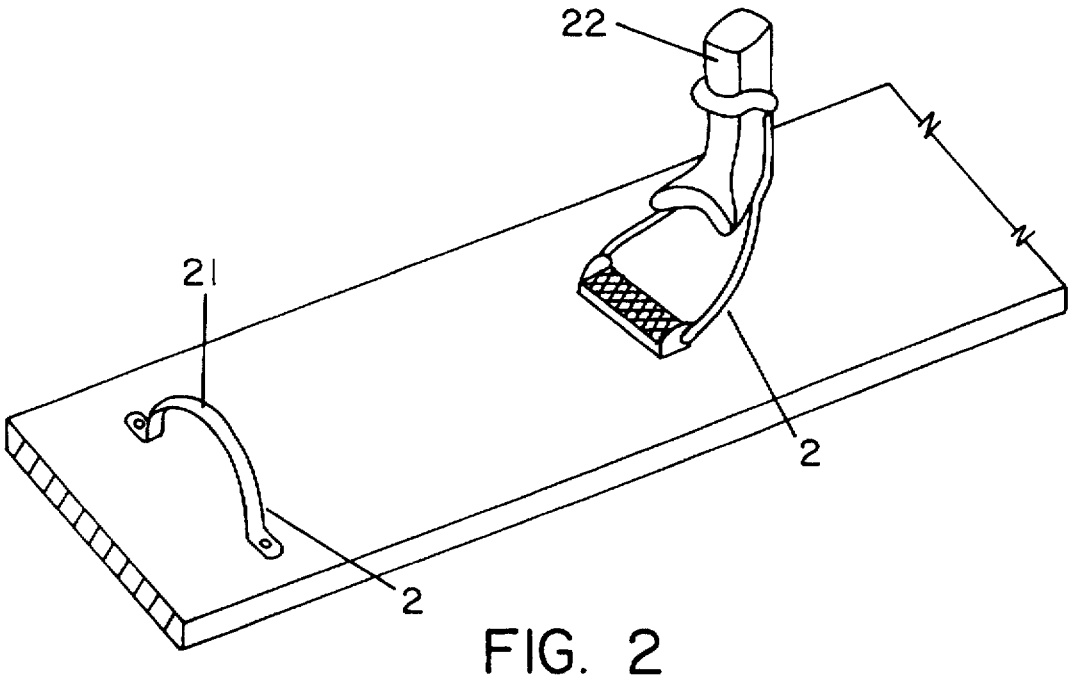
FIG. 2 shows a view of the independent means for the self-contained releasable binding structure, mounted on the ski means including a front safety abutment and a back safety abutment which is detachable, used for cross country skiing.

The binding assembly 30, shown in FIG. 1, also includes means for cooperating with the means of the releasable binding assembly shown in FIG. 2. A front part 303 of the binding 30 includes a cover 300 which is able to be inserted into the front strap 21. Once the self-contained assembly is inserted into the front stop, it is surrounded by the cover. Therefore, the space located directly in front of the self-contained assembly by the front stop is clear. A rear part 304 of the binding assembly 30 includes a portion 309, advantageously above of the heel of the skier, suited to cooperate with the releasable stop 22 in order to effect a strong binding as, the one shown in FIG. 3.

Figure 3:
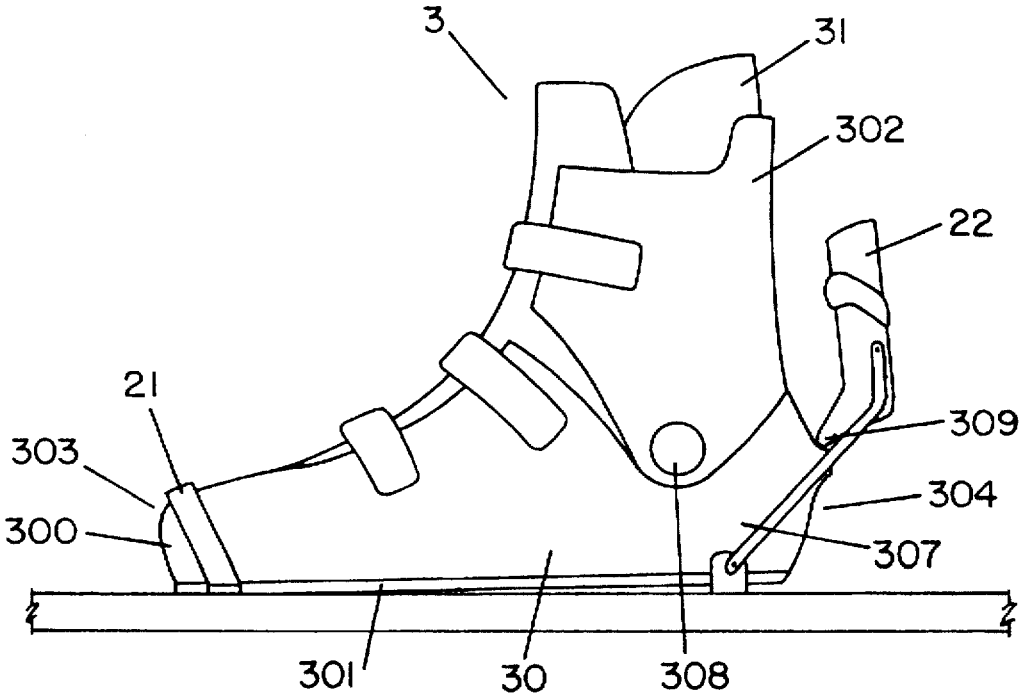
FIG. 3 shows a front view of the assembly with respect to FIG. 1, fixed on the water ski by detachable and independent bindings according to FIG. 2.

The binding means for the releasable binding of the self-contained assembly 3 shown in FIG. 2, comprise a front stop, made up with a strap 21, fixed onto the ski for example, by a screw, immobilizing the front part 303 rigid binding assembly 30, by inserting it into the strap; and a rear safety stop 22 of the type used for the cross country ski bindings, immobilizing the back part 304 of the rigid binding assembly, while supporting the strap 21 on the surface of the ski. In this way, the binding assembly 30 is bound strongly to the ski, like what is shown in FIG. 3, all while allowing a release of the bindings in case the skier falls, especially in case of a front fall; by the release of the front stop, according to a process identical to the one already used for cross country skiing. It is important to note that the strap 21 can work with light metallic materials or steel, covered at least partially by a sheath in plastic material at the level of the contacting part of the strap, especially in order to avoid a marking of the self-contained assembly.

Figure 4:
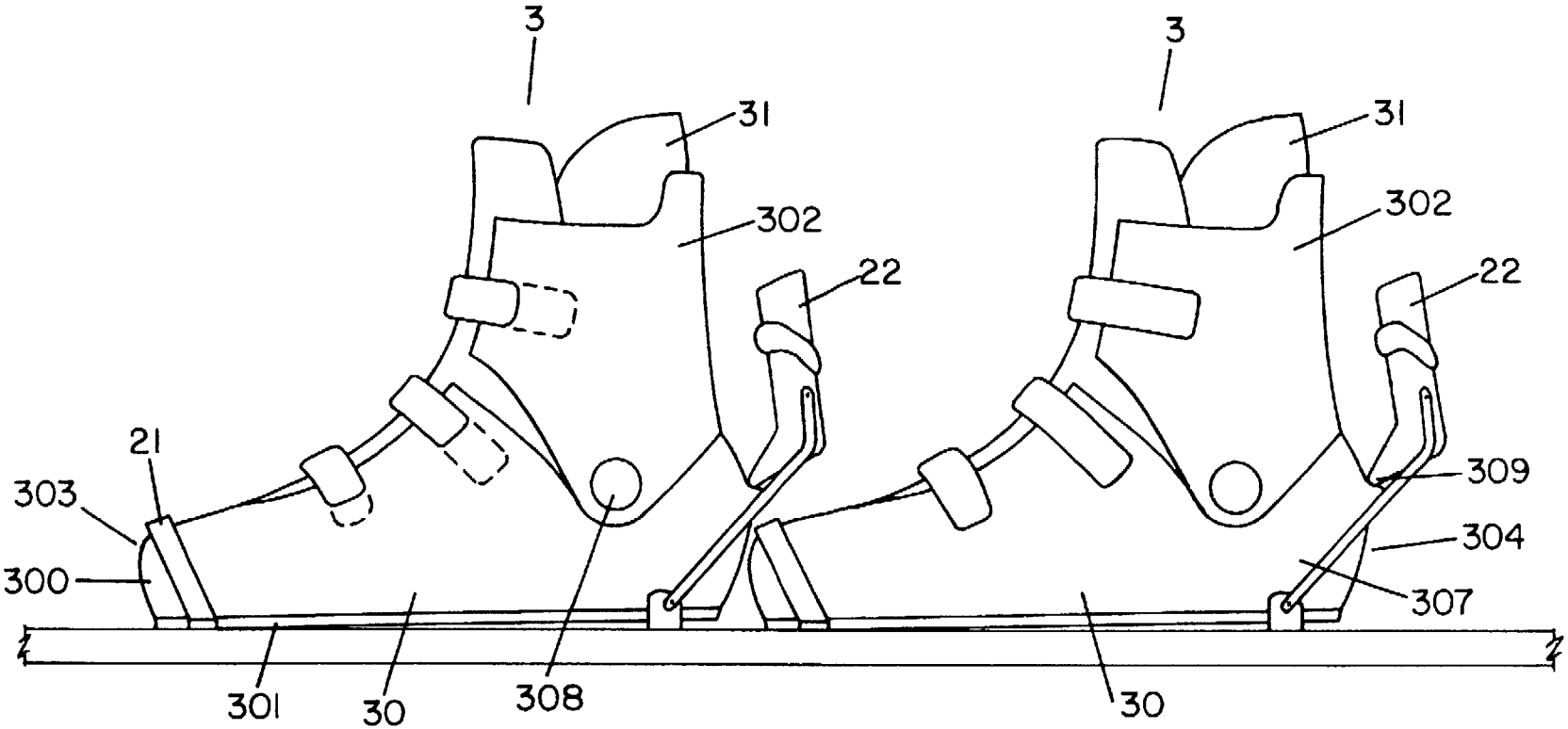
FIG. 4 shows a front view of the two self-contained structures according to FIG. 1, placed one behind the other on a water ski by the detachable independent bindings with respect to FIG. 2.

As has already been noted, the strap 21 and the rear stop 22 are self operating in the binding of the assembly 3, which allows the linking to a monoski two independent assemblies 3, advantageously joined one behind the other as shown in FIG. 4. In FIG. 4 the two rear stop 22 are identical, as are the two straps 21, in a way to insure the interchangeability between the self-contained assemblies and the bindings. In this case, the housings 309 on the bindings are equally identical. In this way, a monoski equipped with the equipment from this invention can be used by a skier who is right or left handed.

Figure 5:
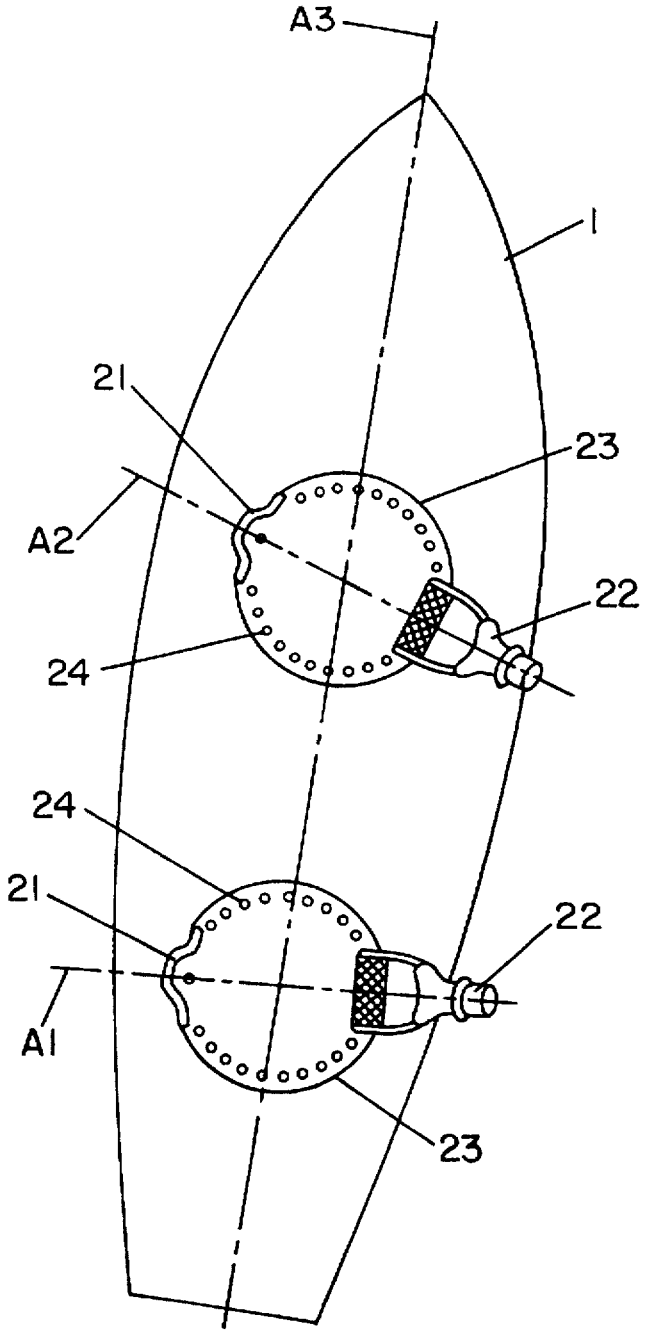
FIG. 5 shows the means of detaching the bindings according to FIG. 2, laid out on the skiboard, and taken from a view from above.

In the embodiment of the invention shown in FIG. 5, a skiboard 1 is equipped with releasable bindings shown in FIG. 4. The self-contained assembly (not shown) can be similar to the self-contained assemblies shown in FIG. 4.

The releasable securing means of binding include two straps 21 and two releasable rear safety stops 22 in order to connect them in an independent way with respect to the two self-contained assemblies on the skiboard 1. Each self-contained assembly is advantageously linked to the skiboard as shown in FIG. 3.

The strap 21 and the rear stop 22 for each self-contained assembly are fixed on the skiboard 1 by an intermediate plate 23, which has the goal of allowing a possibility of modifying the angular orientation relative to the longitudinal axes A1 and A2 of the self-contained assemblies between them, and a possibility of modifying the angular orientation of them with respect to the longitudinal axis A3 of the skiboard. These possibilities of modifying the angular position of the self-contained assemblies allow the skis to be able to adapt the position of the feet on the skiboard before use, especially depending on the skier's body type or the preference for positions for the practice of the sport.

The strap 21 and the rear stop 22 advantageously fixed on the plate 23, and can be released by using a screw in order to allow interchangeability of the parts. The plate 23 is fixed to the skiboard 1 by the screw 24 which is placed in a circumferential way to allow different angle positions of axes A1 and A2 with respect to axis A3, according to an angular step, for example 5 degrees.

The plate 23 can be in a circular shape and can be made of light metallic material or of rigid composite plastic.

It is important to note that the realization of the binding equipment of the skier to a skiboard or to a water ski according to this invention can occur using simple industrial application methods, which are currently more advantageous than those used in the production of sports equipment, especially cross country skis or roller skates.

I claim:

1. Equipment to enable a skier to engage in waterskiing on a water ski, said equipment comprising:

a first and a second item of footwear placeable one behind the other on the ski; each item of footwear comprising:

a flexible liner completely enveloping a skier's foot, ankle, and the lower portion of the skier's leg, and a rigid, lockable retaining structure completely enveloping said liner and having at least one sole equipped with a heel and a rear section with a part above said heel, a metatarsal strap, an instep strap, and a leg section, and a rear safety stop mountable on the water ski for releasably holding the skier on the ski, said releasable rear safety stop comprising means for engaging said part above said heel of said rear section, for abutting said rigid lockable retaining structure and for enabling the positioning of the said first and second item of footwear, one behind the other.

2. Equipment according to claim 1 wherein each part of said rear section above said heel of each of said rigid lockable retaining structures comprise a rear section cooperating with said rear safety stop for releasably securing the foot to said equipment.

3. Equipment according to claim 1, said releasable rear safety stops of said items of footwear are identical in order to permit their interchangeability between said items of footwear.

4. Equipment according to, claim 2, wherein said parts above said heel of said releasable rear safety stops are identical to make them interchangeable in said items of footwear.

5. Equipment according to claim 1, each of said releasable rear safety stops are rear stops of the type used in cross country ski bindings.

6. Equipment according to claim 1, wherein at least one of said lockable retaining structures comprises a front section having a toe cover, and said equipment further comprises a front stop for going around said toe cover for enabling an abutting positioning of said footwear o the ski.

7. Equipment according to claim 6, wherein both of said lockable retaining structures comprise a front section having a toe cover, and said equipment comprises front stops for receiving and going around said toe covers.

8. Equipment according to claim 7 wherein said front stops are identical to make them interchangeable for cooperation with said first and second items of footwear.

9. Equipment enabling a skier to engage in skiboarding on a skiboard, said equipment comprising:

a first and second item of footwear, said first and second items of footwear being placeable on the said skiboard, along a first longitudinal axis and a second longitudinal axis, respectively, not parallel to a central longitudinal axis of the skiboard, each item of footwear comprising:

a flexible liner enveloping the skier's foot, heel, and a lower part of the skier's leg, rigid lockable rigid structure completely enveloping said liner and having at least one sole equipped with a heel and a rear section with a part above said heel, a metatarsal strap, an instep strap, and a leg section; and a releasable rear safety stop mountable on the said skiboard for releasably holding the skier on the skiboard, said releasable rear safety step comprising means for engaging said part above said heel for abutting said rigid lockable retaining structure and for releasing in response to a forward fall of the skier.

* * * * *